US007519194B2

(12) United States Patent
Niederdränk et al.

(10) Patent No.: US 7,519,194 B2
(45) Date of Patent: Apr. 14, 2009

(54) HEARING AID SYSTEM AND OPERATING METHOD THEREFOR IN THE AUDIO RECEPTION MODE

(75) Inventors: Torsten Niederdränk, Erlangen (DE); Gottfried Rückerl, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 770 days.

(21) Appl. No.: 11/186,746

(22) Filed: Jul. 21, 2005

(65) Prior Publication Data

US 2006/0018496 A1 Jan. 26, 2006

(30) Foreign Application Priority Data

Jul. 21, 2004 (DE) ..... 10 2004 035 256

(51) Int. Cl.
*H04R 25/00* (2006.01)

(52) U.S. Cl. ..... 381/330; 381/312

(58) Field of Classification Search ..... 381/23.1, 381/91, 92, 312, 314, 315, 317, 318, 320, 381/321, 323

See application file for complete search history.

(56) References Cited

U.S. PATENT DOCUMENTS

| | | | | |
|---|---|---|---|---|
| 5,757,932 | A * | 5/1998 | Lindemann et al. | 381/312 |
| 6,839,447 | B2 * | 1/2005 | Nielsen et al. | 381/312 |
| 7,020,296 | B2 * | 3/2006 | Niederdrank | 381/312 |
| 2004/0208332 | A1 | 10/2004 | Baechler | |

FOREIGN PATENT DOCUMENTS

| | | |
|---|---|---|
| EP | 0 941 014 A2 | 9/1999 |
| JP | CH675657 | 10/1990 |
| JP | 9116999 | 5/1997 |
| JP | 2002542635 | 12/2002 |

* cited by examiner

*Primary Examiner*—Brian Ensey
(74) *Attorney, Agent, or Firm*—Schiff Hardin LLP

(57) ABSTRACT

In a hearing aid device system with two hearing aids for binaural supply to a hearing aid user, a coupling of the settings of both hearing aids is not always reasonable in the "audio reception" mode and therefore the hearing aid that is in the "audio reception" operating mode is not adapted to changed settings when parameters in the other hearing aid of the hearing aid system have been readjusted. The use of a remote control also has different effects on a hearing aid in the active "audio reception" mode than on the hearing aid device that is in a passive "audio reception" mode.

16 Claims, 1 Drawing Sheet

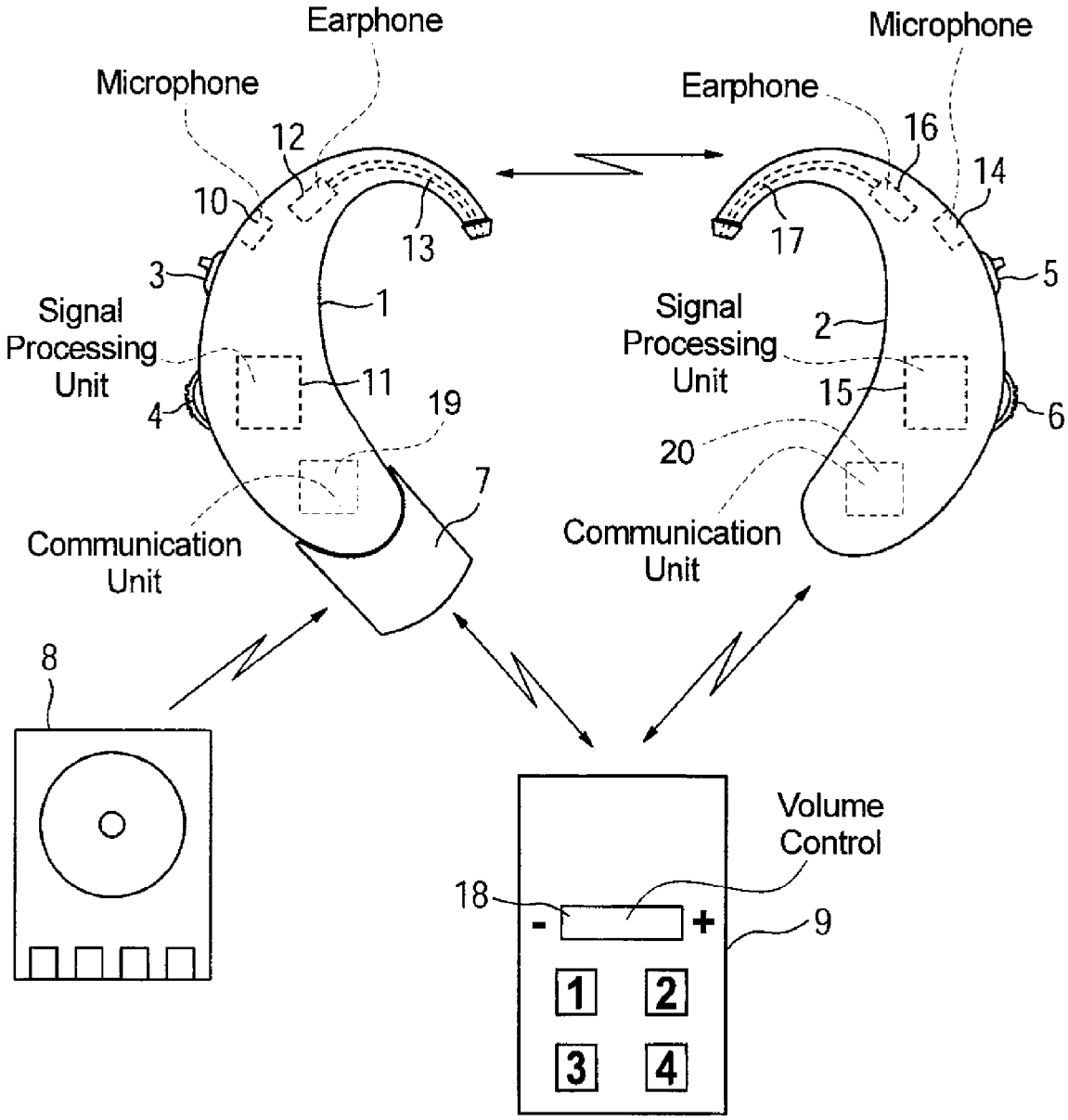
Earphone
Microphone
12
10
13
3
1
Signal
Processing
Unit
11
4
19
7
Communication
Unit
Microphone
Earphone
16
14
17
5
2
Signal
Processing
Unit
15
6
20
Communication
Unit
8
Volume
Control
18
-
+
9
1
2
3
4

HEARING AID SYSTEM AND OPERATING METHOD THEREFOR IN THE AUDIO RECEPTION MODE

BACKGROUND OF THE INVENTION

1. Field of the Invention

The present invention concerns a hearing aid system of the type having two hearing aids that can be worn on the head for binaural supply to the user the hearing aids each having an input transducer for acquisition of an input signal and conversion into an electrical signal, a signal-processing unit for processing and frequency dependent amplification of the electrical signal, and an output transducer for conversion of the processed signal into a signal perceivable as an acoustic signal by the hearing aid user.

The invention also concerns a method for operation of such a hearing aid system.

2. Description of the Prior Art

Hearing aid systems of the above type are known wherein parameters for control of the signal processing in the signal-processing units can be set in the hearing aids for adapting the signal processing to different auditory situations; and wherein control signals for adapting the parameters that are set in one hearing aid to the parameters that are set in the other hearing aid can be transferred between the two hearing aids.

A hearing aid system with two hearing aids that can be worn on the head for binaural supply to the user is known from EP 0 941 014 A2. A control signal is generated by the operation of a control element on one of the two hearing aids of the hearing aid system and is transferred to the second hearing aid, which leads to a simultaneous adaptation of both hearing aids by means of this control signal and the signal-processing units in the respective hearing aids.

Hearing aids have an audio input for connection to external devices such as radios, televisions, CD players, MP3 players etc in an operating mode for the auditory situation known as "audio reception." The connection between the hearing aid and the external device ensues either wirelessly or hardwired. The hearing aid is typically connected with what is known as an "audio shoe" for audio reception. Starting from the audio shoe, a wire can then lead to the external device. Audio shoes are also known that have a transmission and reception unit for wireless data transfer between the hearing aid and an external device. Such wireless systems, for example, also are used in training rooms for hearing impaired persons and are known under the designation "MLX".

Hearing aid systems for binaural supply to a hearing impaired person are frequently operated asymmetrically for audio reception. Only one of the two hearing aids is connected with the audio signal source. In this operating mode, adaptation of the settings of both hearing aids of the hearing aid system is inexpedient.

SUMMARY OF THE INVENTION

An object of the present invention is to provide a reasonable (with regard to their settings) coupling of two hearing aids of a binaural hearing aid system in the "audio reception" and auditory situation.

This object is achieved by a hearing aid system with two hearing aids that can be worn on the head for binaural supply to a user wherein each hearing aid has an input transducer for acquisition of an input signal and conversion into an electrical signal, a signal-processing unit for processing and frequency-dependent amplification of the electrical signal, and an output transducer for converting the processed signal into a signal perceivable as an acoustic signal by the user, and wherein parameters for control of the signal processing in the signal-processing units can be set in the hearing aids for adapting the signal processing to different auditory situations; and wherein control signals for adapting the parameters that are set in one hearing aid to the parameters that are set in the other hearing aid can be transferred between the two hearing aids, and wherein the adaptation of the set parameters between the two hearing aids can be at least partially prevented in the auditory situation "audio reception".

The object also is achieved by a method for operating a hearing aid system with two hearing aids that can be worn on the head for binaural supply to the user, wherein each hearing aid has an input transducer for acquisition of an input signal and conversion thereof into an electrical signal, a signal-processing unit for processing and frequency-dependent amplification of the electrical signal, and an output transducer for converting the processed signal into a signal perceivable as an acoustic signal by the user, wherein parameters for control of the signal processing in the signal-processing units can be set in the hearing aids for adaptation of the signal processing to different auditory situations; and wherein control signals for adapting the parameters that are set in one hearing aid to the parameters that are set in the other hearing aid can be transferred between the two hearing aids, the method including further steps of adapting the parameters to the auditory situation "audio reception" in at least one of the two hearing aids, and at least partially preventing the adaptation of the set parameters between the two hearing aids.

As noted above, in a hearing aid, an input signal is acquired by means of an input transducer and converted into an electrical input signal. At least one microphone that acquires an acoustic input signal typically serves as an input transducer. Modern hearing aids frequently have a microphone system with a number of microphones in order to achieve reception dependent on the incident direction of the acoustic signal, i.e. a directional characteristic. The input transducer also can be a telecoil or an antenna for acquisition of electromagnetic input signals. The input signals converted into electrical input signals by the input transducer are supplied to a signal-processing unit for further processing and amplification. The further processing and amplification for compensation of the individual hearing loss of the hearing aid user normally ensues dependent on the signal frequency. The signal-processing unit emits an electrical output signal that is supplied (via an output transducer) to the ear of the user so that the user perceives the output signal as an acoustic signal. Earpieces that generate an acoustic output signal typically are used as output transducers. Output transducers for generation of mechanical vibrations are also known that directly excite specific parts of the ear such as, for example, the ear ossicles (small ear bones). Furthermore, output transducers are known that directly stimulate nerve cells of the ear.

Hearing aids normally can be adjusted to different auditory situations using different operating modes (acoustic programs). Such auditory situations are, for example, "quiet environment", "television", "speech in interfering noise" etc. A further auditory situation is audio reception, in which the hearing aid is directly connected (via an electrical or electromagnetic connection) with the audio signal source. According to the invention, in a hearing aid system with two hearing aids for binaural supply to a user in which an automatic coupling of settings is provided in both hearing aids, the coupling is at least partially interrupted in the auditory situation "audio reception". This means that manual adjustments on one of the two hearing aids or automatically-implemented parameter changes no longer have effects on the other hearing aid.

If at least one of the two hearing aids is connected with an audio signal source, the hearing aid system is in the auditory situation "audio reception" and the appertaining hearing aids are (manually or automatically) switched into an operating mode adapted to this auditory situation. It is thus placed in a mode for "active audio reception" (active audio mode). If only one of the two hearing aids is connected with the audio signal source, the second hearing aid of the hearing aid system that is not connected with the audio signal source is thus preferably likewise adapted to this particular auditory situation by corresponding parameter settings. It is transferred into a special mode for this "passive audio reception" (passive audio mode). The hearing aid that is in the active audio mode preferably sends a control signal to the second hearing aid and thereby automatically changes this hearing aid into the passive audio mode, insofar as the second hearing aid is not already in the active audio mode.

The special settings of the hearing aid in the active or passive audio mode preferably can be adjusted by a hearing aid acoustician in the adaptation of the hearing aid at the time it is customized for the user. In the passive audio mode, the signal source that corresponds to the desire of the hearing aid user preferably is used to provide an input signal to the appertaining hearing aid. The microphone signal is suggested in order to be able to perceive external noises, or a muting of the hearing aid. Except for the transfer of the one hearing aid into the passive audio mode by the hearing aid in the audio reception mode, the reciprocal control of setting parameters in the binaural hearing aid system is substantially cancelled. If both hearing aids are in the audio reception mode, no reciprocal influencing ensues at all any more in this operating mode.

If a manual operation of a control element by the user ensues in one of the hearing aids in the hearing aid system according to the invention, this effects the desired adjustment in this hearing aid. For example, a volume adjustment that is independent of the setting of the other hearing aid is thereby possible. The balance between the hearing aids can be varied in this manner.

If a remote control is included in the hearing aid system, its operation can affect both hearing aids. For example, a volume adaptation can lead to a relative change of the volume setting of both hearing aids, with the set balance being maintained due to the negated (cancelled) absolute value coupling. In contrast to this, preferably a program switch by means of the remote control merely leads to an adaptation of the hearing aid in the audio mode to different signal sources, for example pure audio reception or mixed operation "audio reception" and "microphone reception". A hearing aid in the passive audio mode is then not affected by such a program switch.

When, in the hearing aid system according to the invention, the audio reception ends, so that neither of the two hearing aids is connected with an audio signal source any longer, the hearing aid system according to the invention preferably reverts to the settings pertaining to the hearing aids had before beginning the audio reception. Given an unequal volume setting (balance), the hearing aid formerly operated in the active audio mode provides the volume setting and the second hearing aid is slowly adapted to this setting ("fading") in the necessary adaptation.

DESCRIPTION OF THE DRAWING

The single FIGURE schematically illustrates a binaural hearing aid system constructed and operating in accordance with principles of the present invention

DESCRIPTION OF THE PREFERRED EMBODIMENTS

The FIGURE shows a hearing aid system with a hearing aid 1 that can be worn behind the left ear and a hearing aid 2 that can be worn behind the right ear for binaural supply to a hearing aid user. In the hearing aids 1 and 2, respective microphones 10 and 14 serve for acquisition of an acoustic input signal and conversion thereof into an electrical signal. This signal is processed further in signal-processing units 11 and 15, respectively. Dependent on the signal frequency, the signals are respectively amplified for compensation of the individual hearing loss of the hearing aid user. The processed and amplified signals are respectively converted back into an acoustic signal by earpieces 12 and 16 and are supplied to the ears of the hearing aid user via respective sound channels 13 and 17 and subsequent sound tubes (not shown).

The signal-processing units 11 and 15 also contain control programs that control the overall operation of the respective hearing aids 1 and 2.

The hearing aids 1 and 2 are wirelessly coupled via respective communication units 19 and 20 so that automatically or manually implemented changes to the settings in one of the two hearing aids has an effect on the other hearing aid. For example, if the hearing aid 1 is manually adjusted by operation of the volume controller 4 or by activation of a program selection button 3, the volume is also changed in the hearing aid 2, or the active acoustic program thereof is also switched without having to operate the program selection button 5 or the volume controller 6 if the hearing aid 2 for this purpose.

In the operating mode shown in the FIGURE, the hearing aid system is in the audio reception mode since at least one of the hearing aids (hearing aid 1) is connected with an audio shoe 7. In the exemplary embodiment, this is plugged into the lower end of the hearing aid 1. The audio shoe 7 in the exemplary embodiment contains a reception unit for wireless reception of an electromagnetic signal emanating from an audio signal source. In the exemplary embodiment, the audio signal source is a CD player 8 with a transmitter. In this special operating mode, activation of the control elements 3 or 4 has no effect on the hearing aid 2. In reverse, activation of the control elements 5 or 6 on the hearing aid 2 does not affect the hearing aid 1.

In the exemplary embodiment, upon plugging the audio shoe 7 onto the hearing aid 1, it is switched into the active audio reception mode. The hearing aid 1 thereupon sends a signal via the communication units 19 and 20 to the hearing aid 2 that is not connected with an audio shoe causing the hearing aid 2 to shift into the passive audio reception mode. In the passive audio reception mode, the hearing aid 2 is set according to the specifications of the user (for example to microphone reception or mute) established in the programming of the hearing aid 2. Aside from the switch of the hearing aid 2 into the passive audio reception mode by the hearing aid 1, no further mutual influencing of the hearing aids 1 and 2 ensues during the audio reception operation. After the end of the audio reception mode, i.e. by detaching the audio shoe 7 from the hearing aid 1, the hearing aid 1 reverts into the original operating mode in which it was operating before the beginning of the audio reception mode. Furthermore, a signal is transmitted from the hearing aid 1 to the hearing aid 2 that indicates the end of the audio reception operation and that resets the hearing aid 2 into the original operating mode.

The hearing aid system according to the exemplary embodiment furthermore has a remote control 9 that communicates with the hearing aids 1 and 2 via the communication units 19 and 20. This has program buttons (labeled A through D) for program selection as well as a rocker switch 18 for volume adjustment. In the audio mode, a program switch by activation of one of the buttons A through D affects only the hearing aid 1. For example, a pure audio reception or a mixed operation with audio and microphone reception can be set. In contrast, a change of the volume setting by activation of the rocker switch 18 affects both hearing aids 1 and 2, by the volume being increased or decreased by a specific value in both hearing aids 1 and 2.

A reasonable adjustment of the hearing aids 1 and 2 given direct operation of one of the two hearing aids 1 or 2 or given operation of the hearing aid system by means of remote control is achieved in the audio reception mode by the invention in a hearing aid system for binaural feed supply to a user. The remote control also remains reasonably adjustable in the binaural hearing aid system with coupled settings with either one-sided or two-sided use of an audio shoe. The hearing aid system automatically adapts to the preferences of the hearing aid user in this special auditory situation.

Although modifications and changes may be suggested by those skilled in the art, it is the intention of the inventors to embody within the patent warranted hereon all changes and modifications as reasonably and properly come within the scope of their contribution to the art.

We claim as our invention:

1. A binaural hearing aid system comprising:

first and second hearing aids adapted to be simultaneously worn at the head of a user for binaural amplification of an electrical signal;

each of said first and second hearing aids comprising an input transducer that detects an acoustic input signal and converts said acoustic input signal into said electrical signal, a signal-processing unit supplied with said electrical signal that processes and frequency-dependent amplifies said electrical signal, dependent on selected parameters, to produce a processed electrical signal, an output transducer supplied with said processed electrical signal that converts said processed electrical signal into an output signal perceivable by the user as an acoustic signal, and a communication unit connected to the signal-processing unit, and a parameter setting arrangement in communication with the signal-processing unit allowing entry of said parameters into said signal-processing unit, said communication units in the respective first and second hearing aids communicating with each other to automatically communicate parameters that are set in one of said first and second hearing aids to the other of said first and second hearing aids; and at least said first hearing aid comprising an audio input allowing direct electrical supply of an audio input signal, from an audio signal source, to the signal processor in said first hearing aid, the signal processor in said first hearing aid then operating in an audio reception mode and limiting, to selected parameters, the parameters that are automatically communicated from said first hearing aid to said second hearing aid.

2. A hearing aid system as claimed in claim 1 comprising an audio shoe that is detachably connectable to said audio input of said first hearing aid, connection of said audio shoe to said audio input automatically placing said signal processor in said first hearing aid in said audio reception mode.

3. A hearing aid system as claimed in claim 1 wherein, in said audio reception mode, said signal processor in said first hearing aid permits only communication of parameters relating to different audio signal sources and does not permit communication of parameters relating to different acoustic environments.

4. A hearing aid system as claimed in claim 1 wherein said signal processor in said first hearing aid in said audio reception mode causes a parameter to be communicated via said communication units to said second hearing aid to place said second hearing aid in a passive audio reception mode.

5. A hearing aid system as claimed in claim 4 comprising a remote control in communication with each of said first and second hearing aids via the respective communication units therein, said remote control comprising an actuation element allowing changing of acoustic programs in the respective signal-processing units of the first and second hearing aids, with actuation of said actuation element being ineffective to change the acoustic program in the signal-processing unit of said second hearing aid when said second hearing aid is in said passive audio reception mode.

6. A hearing aid system as claimed in claim 4 comprising a remote control having a volume control allowing selective adjustment of volume in both of said first and second hearing aids even if said second hearing aid is in said passive reception mode.

7. A hearing aid system as claimed in claim 6 wherein said remote control changes the volume in one of said first and second hearing aids, and wherein said one of said first and second hearing aids in which the volume has been changed automatically communicates with the other of said first and second hearing aids to effect an equal change in the volume of said other of said first and second hearing aids.

8. A method for operating a binaural hearing aid system comprising first and second hearing aids adapted to be simultaneously worn at the head of a user for binaural correction of a hearing impairment, comprising the steps of:

normally allowing communication between said first and second hearing aids, when signal-processing parameters are set in one of said hearing aids, to automatically change signal-processing parameters in the other of said hearing aids;

placing one of said hearing aids in an audio reception mode wherein an audio input signal, from an audio input source, is directly electrically supplied to the signal processor in the hearing aid in the audio reception mode; and when said one of said hearing aids is in said audio reception mode, limiting communication of parameters between said hearing aids to only predetermined parameters.

9. A method as claimed in claim 8 comprising placing said one of said hearing aids in said audio reception mode by attaching an audio shoe to said one of said hearing aids.

10. A method as claimed in claim 8 wherein the step of normally communicating parameters comprises normally communicating parameters relating to a change in auditory environment, and wherein the step of limiting communication of said parameters comprises preventing communication of said parameters relating to a change in auditory environment.

11. A method as claimed in claim 8 wherein said one of said hearing aids in said audio reception mode automatically communicates with the other of said hearing aids to place said other of said hearing aids in a passive audio reception mode.

12. A method as claimed in claim 11 comprising operating said hearing aids with a remote control, and allowing adaptation via said remote control only of said hearing aid in said audio reception mode to different signal sources, and automatically preventing said adaptation for said hearing aid in said passive audio reception mode.

13. A method as claimed in claim 11 comprising operating said hearing aids with a remote control and allowing volume adjustment via said remote control for the hearing aid in said audio reception mode as well as the hearing aid in said passive audio reception mode.

14. A method as claimed in claim 13 comprising automatically changing the volume in each of said hearing aids by an equal amount.

15. A method as claimed in claim 11 comprising taking said hearing aid in said audio reception mode out of said audio reception mode, and automatically causing the hearing aid in said passive audio reception mode to revert to a previous operational mode.

16. A method as claimed in claim 15 comprising automatically gradually changing a volume of the hearing aid previously in the passive audio reception mode to a volume appropriate for said previous operational mode.

* * * * *